US005827100A

United States Patent [19]

Kim

[11] Patent Number: 5,827,100

[45] Date of Patent: Oct. 27, 1998

[54] METHOD FOR MANUFACTURING FIELD EMISSION DEVICE

[75] Inventor: Jong-min Kim, Seoul, Rep. of Korea

[73] Assignee: Samsung Display Devices Co., Ltd., Suwon, Rep. of Korea

[21] Appl. No.: 731,150

[22] Filed: Oct. 10, 1996

[30] Foreign Application Priority Data

Nov. 14, 1995 [KR] Rep. of Korea ..... 95-41246

[51] Int. Cl.[6] ..... H01J 9/02

[52] U.S. Cl. ..... 445/24; 445/50

[58] Field of Search ..... 445/24, 50

[56] References Cited

U.S. PATENT DOCUMENTS

| | | | |
|---|---|---|---|
| 5,064,396 | 11/1991 | Spindt | 445/50 |
| 5,319,279 | 6/1994 | Watanabe et al. | 313/309 |
| 5,643,032 | 7/1997 | Cheng et al. | 445/24 |

FOREIGN PATENT DOCUMENTS 0 483 814 5/1992 European Pat. Off. .

*Primary Examiner*—Kenneth J. Ramsey

*Attorney, Agent, or Firm*—Foley & Lardner

[57] ABSTRACT

A method for manufacturing a field emission device includes forming a cathode on a substrate. A semiconductor material layer is formed on the cathode and a mask is formed on the semiconductor material layer. The semiconductor material layer is etched to form tips on the cathode. Each of the tips has an upper portion and a lower portion. An insulating material is deposited on the cathode to form an insulating layer. A first metal is deposited on the insulating layer in a slanted angle direction to form a gate electrode having a protruded edge portion. The mask and the tips are removed to form holes. A second metal is deposited on the gate electrode to form micro-tips in the holes. The second metal is then removed from the gate electrode. The upper portion of the tips may have a cone shape, while the lower portion of the tips may have a column shape. The upper and lower portions of the tips may be formed by two different etching methods. The resulting field emission device may be applied, among other things, to a flat plate display device, an extremely high frequency amplifier, and a sensor. According to the above method, the gate is precisely formed to have an aperture whose size is minute and uniform, thereby lowering a voltage for driving the display.

10 Claims, 5 Drawing Sheets

METHOD FOR MANUFACTURING FIELD EMISSION DEVICE

BACKGROUND OF THE INVENTION

The present invention relates to a method for manufacturing a field effect device having a fine gate design.

A conventional field effect device, as shown in FIGS. 1 and 2, includes a substrate 1, a cathode layer 2 formed thereon, a micro-tip 2*a* formed on the cathode layer 2 and housed in a penetrating hole 3*p* of an insulation layer 3 formed on the cathode 2, and a gate electrode 4 having a penetrated aperture 4*p* corresponding to the penetrating hole 3*p* is deposited on the insulation layer 3. Here, FIG. 2 shows a three-dimensional figure of a conventional field effect electron emission device.

In the conventional field effect device having such a structure, electrons are emitted from the micro-tip 2*a* by an electric field induced by the voltage between the cathode layer 2 and the gate electrode 4. However, since the electric field is formed between the gate electrode 4 and the micro-tip 2*a,* an electron emission according to a tunneling effect is not easily performed in the micro-tip 2*a* due to the integration of the electric field in the upper end portion of the micro-tip 2*a*. (Controlling the diameter of the aperture of the gate is important.)

Namely, multiple electrical potential walls are formed since the electric field is mainly formed in the upper end portion of the micro-tip 2*a* even though the electrons move from the lower to upper end of the micro-tip 2*a*. Therefore, the electrons do not substantially collect in the upper portion of the micro-tip 2*a*. To overcome the problem of low electron movement caused by such a potential barrier, a voltage forming the electric field is increased, thereby causing excessive consumption of electric power. Also, excessive Joule heat is generated, thereby causing thermal damage whereby multiple leakage currents may be generated through the insulation layer 3 formed of $SiO_2$, etc, existing between the cathode layer 2 and the gate electrode 4 according to the application of a high voltage.

Also, in the manufacturing process, it is difficult to control the uniformity of the micro-tip 2*a* since the micro-tip 2*a* is formed by using a parting layer 5 (or a sacrifice layer) as shown in FIG. 3. Moreover, in such a manufacturing process, it is difficult to control the diameter $d_1$ of the gate aperture for evenly emitting an electron beam.

SUMMARY OF THE INVENTION

It is an object of the present invention to provide a method for manufacturing a field effect device wherein the diameters of both a micro-tip and the aperture of a gate are formed to be minute and uniform to effectively control the electron beam which is emitted from the micro-tip. To achieve the object, there is provided a method for manufacturing a field emission device according to the present invention, including the steps of forming a cathode of a predetermined pattern on a substrate, forming a semiconductor material layer by depositing a semiconductor material for forming a hole structure having a predetermined diameter on the deposited layer, forming a mask on the semiconductor material layer, forming the semiconductor material layer into a tip pattern having a cone-shaped upper portion and column-shaped lower portion by etching the same with the mask thereon, forming an insulation layer using the mask and depositing an insulating material all over the cathode which has been deposited on the substrate having a semiconductor material of the tip pattern, forming a gate by depositing a metal all over the insulating layer, step for removing the mask, an insulating material deposited on the mask, and a residual gate metal, forming a hole by etching the semiconductor material of the tip pattern, forming a parting layer on the gate layer and forming a micro-tip in the hole by depositing the metal all over the parting layer by using the mask, and removing the residual metal remaining after forming the micro-tips from the cathode by etching the parting layer.

In the step for forming the semiconductor material layer, the semiconductor material layer is preferably deposited to a thickness of between about 1.5 $\mu$m and 2 $\mu$m by an electron-beam deposition method and the mask is formed by patterning Al or Cr to a thickness of between about 0.1 $\mu$m and 0.2 $\mu$m by using a lift-off method.

The step for forming the tip pattern comprises forming a cone-shaped upper portion by performing an isotropic etching on the semiconductor material layer by a reactive ion etching method using $SF_6/O_2$ plasma by using the mask and forming a column-shaped lower portion by performing an anisotropic etching on the semiconductor material layer by a reactive ion etching method using $CF_4/O_2$ plasma by using the mask.

The height of the cone-shaped upper portion and the column-shaped lower portion are about 1 $\mu$m, respectively.

The insulation layer is formed by depositing $SiO_2$ to a thickness of about 1 $\mu$m, i.e., to the height of the column-shaped lower portion.

The gate is formed to have a protruded edge portion extending toward the upper direction by being deposited by a metal electron-beam irradiated at a direction of between about 65° and 75° with respect to horizontal surface.

The hole is formed by selectively etching the tip pattern by a $SF_6/O_2$ plasma by using the gate as a mask.

The parting layer is formed by depositing Al to a thickness of between about 2000 Å and 3000 Å by an electron-beam deposition method.

The micro-tips are formed by depositing Mo on the parting layer by an electron-beam deposition method by an electron-beam irradiated from a 90° perpendicular direction.

The parting layer is removed by the lift-off method for removing the parting layer by etching the same by a wet chemical etching method.

BRIEF DESCRIPTION OF THE DRAWINGS

The above objects and advantages of the present invention will become more apparent by describing in detail a preferred embodiment thereof with reference to the attached drawings in which:

FIG. 5 shows a schematic sectional view after forming a mask;

FIG. 6 shows a schematic sectional view after performing an isotropic etching by a reactive ion etching method;

FIG. 7 shows a schematic sectional view after performing an anisotropic etching by a reactive ion etching method;

FIG. 8 shows a schematic sectional view after depositing an insulation layer and a gate;

FIG. 9 shows a schematic sectional view after performing a lift-off method for etching a mask;

FIG. 10 shows a schematic sectional view after forming a hole by etching a silicon;

FIG. 11 is a schematic sectional view showing a process for forming a micro-tip by depositing a metal after forming a parting layer;

FIG. 12 shows a schematic sectional view after completing a device by removing unnecessary evaporated materials.

DETAILED DESCRIPTION OF THE INVENTION

Preferred embodiments according to the present invention are described in detail with reference to the attached drawings, hereinafter.

Figure 1:
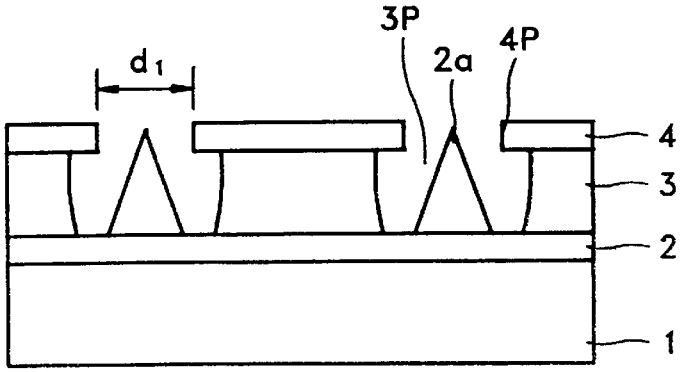
FIG. 1 (PRIOR ART)
FIG. 1 is a schematic sectional view of a conventional field emission device.
Figure 3:
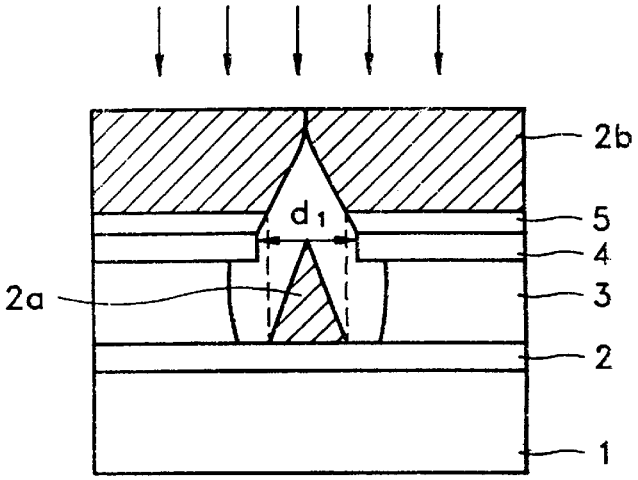
FIG. 3 (PRIOR ART)
FIG. 3 is a schematic sectional view showing a manufacturing process of a field emission device.
Figure 4:
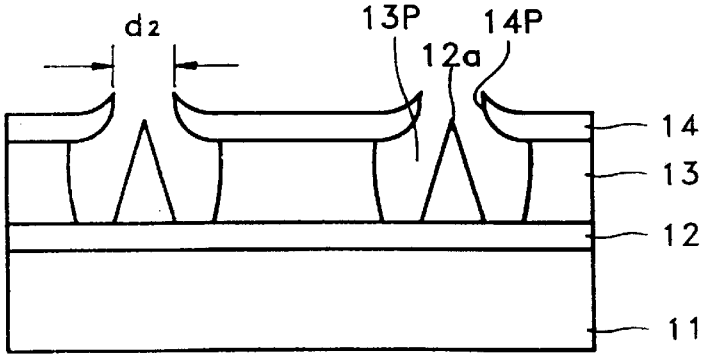
FIG. 4 is a schematic sectional view of a field device according to the present invention.
Figure 2:
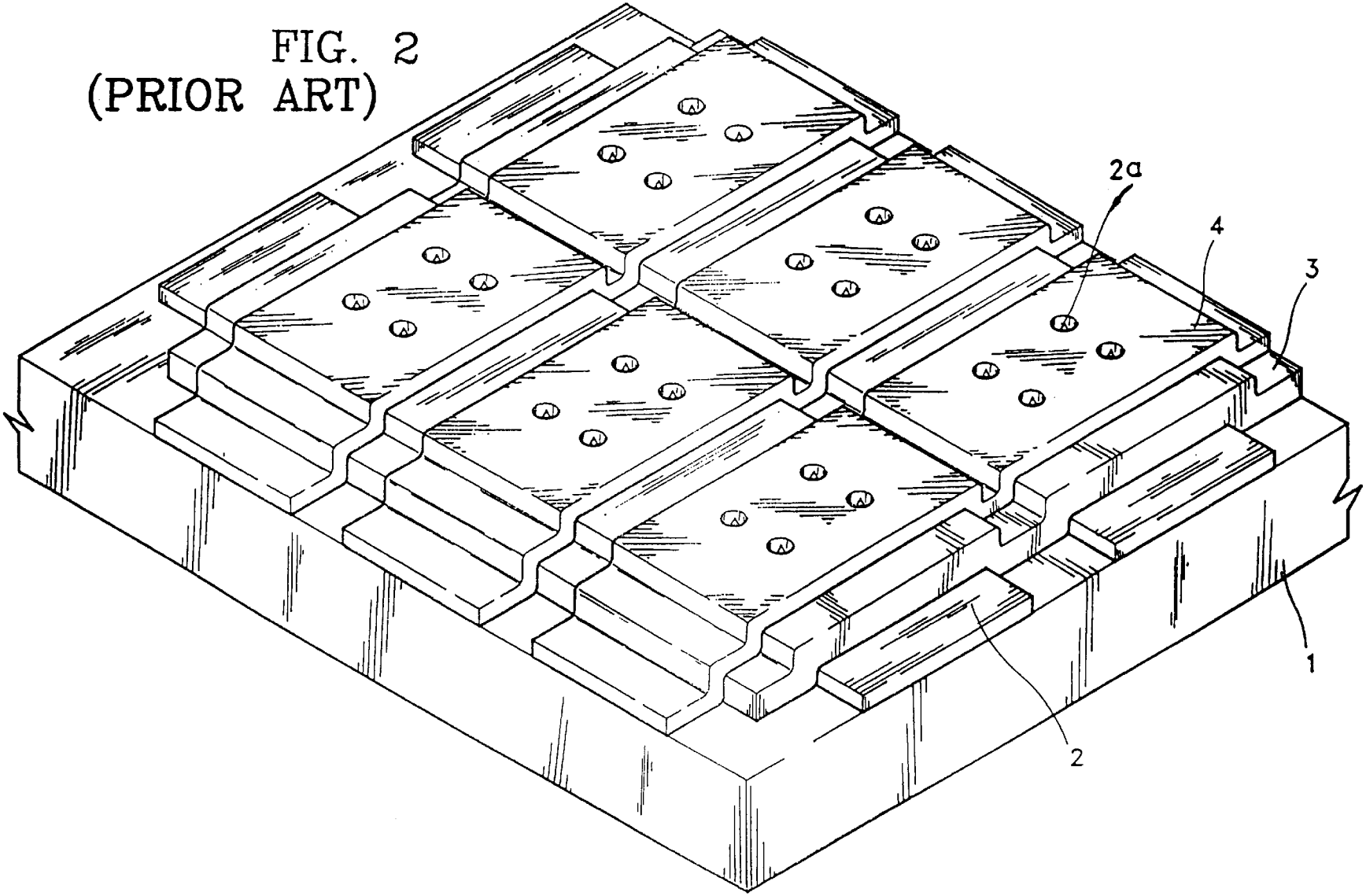
FIG. 2 (PRIOR ART)
FIG. 2 is a schematic perspective view of the field emission device of FIG. 1.

The structure of the field emission device according to the present invention is described as follows with reference to FIG. 4.

An indium tin oxide (ITO) cathode 12 is formed on a substrate 11 and multiple micro-tips 12*a* are formed to be electrically connected to the cathode 12. The micro-tips 12*a* are formed by depositing Molybdenum. An insulation layer 13 and a gate 14 are formed on the cathode layer 12, respectively, to surround the micro-tips 12*a*. Namely, the insulation layer 13 and the gate 14 are formed to include multiple penetrated holes 13*p* which house the micro-tips. The insulation layer 13 is formed by depositing $SiO_2$ to a thickness of about 1 $\mu$m onto the cathode layer 12 and the gate 14 is formed to have the edge portion thereof above the micro-tip 12*a* slightly extended toward the upper portion thereof by depositing a metal by a deposition method using a directional electron-beam between about 65° and 75°. The aperture diameter of the gate is controlled to have a width of between about 0.3 $\mu$m and 1 $\mu$m. The electron beam emitted from the micro-tips 12*a* can be driven by a lower voltage by minutely and uniformly manufacturing the aperture 14*p* of the gate.

Hereinafter, the method for manufacturing the field effect electron emission device having the above structure is described with reference to FIGS. 5 to 12.

Figure 5:
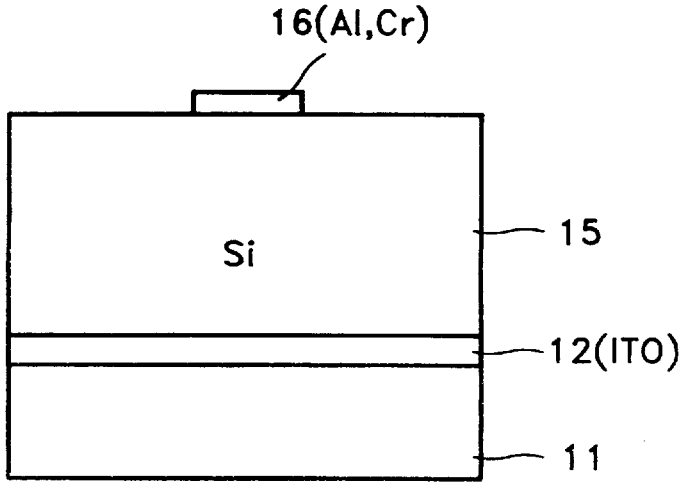
FIG. 5 to FIG. 12 show process orders of the respective manufacturing steps of the field emission device of FIG. 4.

As shown in FIG. 5, the cathode 12 is formed on a glass substrate 11 by depositing and patterning an indium tin oxide (ITO). A semiconductor material 15 such as Si is deposited on the cathode 12 by the electron-beam deposition method to a thickness of between about 1.5 $\mu$m and 2 $\mu$m. A mask 16 is formed on the Si layer 15 by patterning Al or Cr to a thickness of between about 0.1 $\mu$m and 0.2 $\mu$m. The process of forming the mask 16 is composed of a method for patterning a hole having a diameter of between about 1 $\mu$m and 2 $\mu$m by using a photolithography method after coating a photoresist on the Si layer 15 and a method for depositing Al or Cr to a thickness of between about 0.1 $\mu$m and 0.2 $\mu$m on the hole and performing an etching method on the remaining portion. An inexpensive contact printing and a stepper can be used for the hole pattern of this case.

Figure 6:
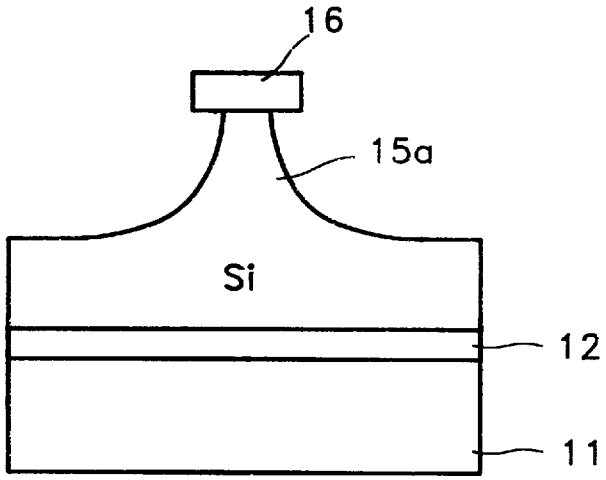
Figure 7:
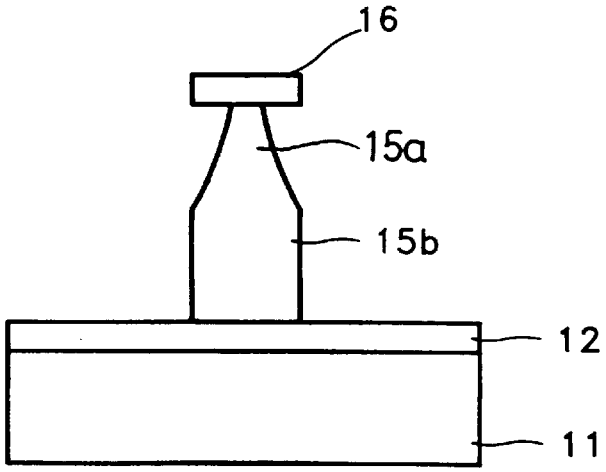
Figure 8:
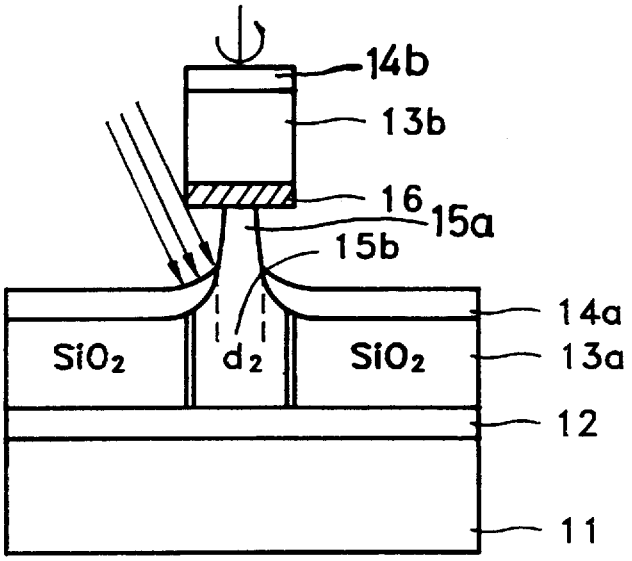

As shown in FIGS. 6 and 7, the Si layer 15 is formed into a tip pattern having a cone-shaped upper portion 15*a* and a column-shaped lower portion 15*b* by etching using the mask 16. Such tip patterns 15*a*, 15*b* are manufactured as follows: first, the cone-shaped upper portion 15*a* is formed by performing isotropic etching on the Si layer 15 with the reactive ion etching method using $SF_6/O_2$ plasma with the mask 16 as shown in FIG. 6, and then a column-shaped lower portion 15*b* is formed by performing anisotropic etching on the Si layer having the cone-shaped upper portion 15*a* with the reactive ion etching method using $CF_4/O_2$ plasma with the mask 16 as shown in FIG. 7. Here, the height of the cone-shaped upper portion 15*a* and the column-shaped lower portion 15*b* should be about 1 $\mu$m, respectively. As shown in FIG. 8, the insulation layer 13*a* is formed by depositing $SiO_2$ to a thickness of about 1 $\mu$m on the cathode 12 using the electron-beam deposition method. Using the electron-beam deposition method, the gate 14*a* is deposited on the $SiO_2$ insulating layer 13*a* and lower area of the cone-shaped upper portion 15*a* so that a volcanic-like crater will be formed when the tip patterns 15*a*, and 15*b* are removed. The outer slopes of the volcanic-like crater are formed by irradiating the metal electron-beam obliquely to the plane of the mask 16 during deposition. By forming the gate 14*a* in this way, the diameter $d_2$ of the gate aperture can be uniformly lowered to about 0.3 $\mu$m–1 $\mu$m with the pattern (the mask) having a diameter of about 2 $\mu$m.

Figure 9:
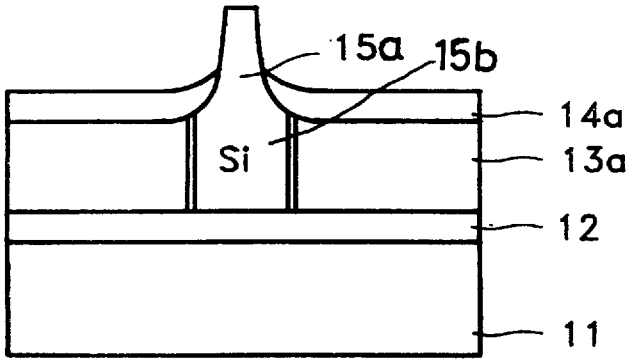

The mask 16, the insulation material 13*b* deposited on the mask 16, and the metal for forming the risidual gate metal 14*b* shown in FIG. 8, are removed by using the lift-off procedure employing a wet chemical etching method as shown in FIG. 9.

Figure 10:
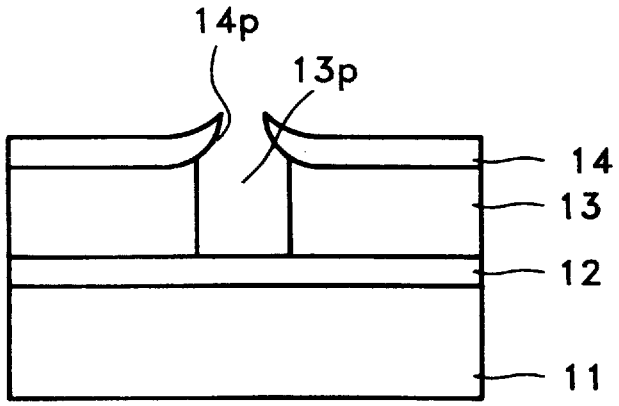

The gate aperture 14*p* and the hole 13*p* are formed by selectively etching the tip patterns 15*a*, 15*b* using $SF_6/O_2$ plasma as shown in FIG. 10.

Figure 11:
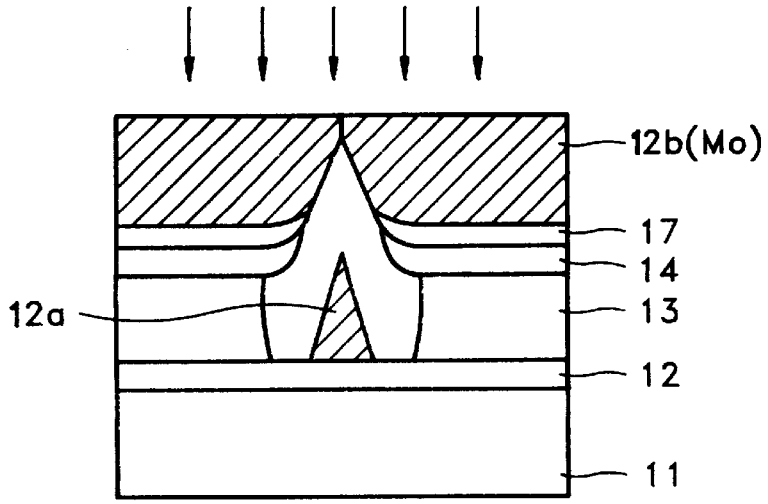
Figure 12:
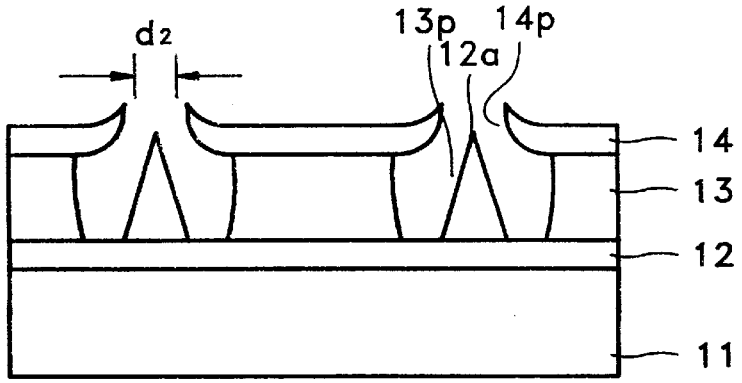

Referring to FIG. 11, the micro-tips 12*a* are formed by depositing the parting layer 17 by depositing Al on the gate 14 to a thickness of between about 2000 Å and 3000 Å using the electron-beam deposition method and irradiating the Mo electron-beam perpendicularly above the upper portion of the parting layer 17 and a Mo layer is formed thereon. A device is completed by removing the additionally deposited Mo layer 12*b* using the lift-off method which etches the Al parting layer 17 by the wet chemical etching method as shown in FIG. 12.

Figure 13:
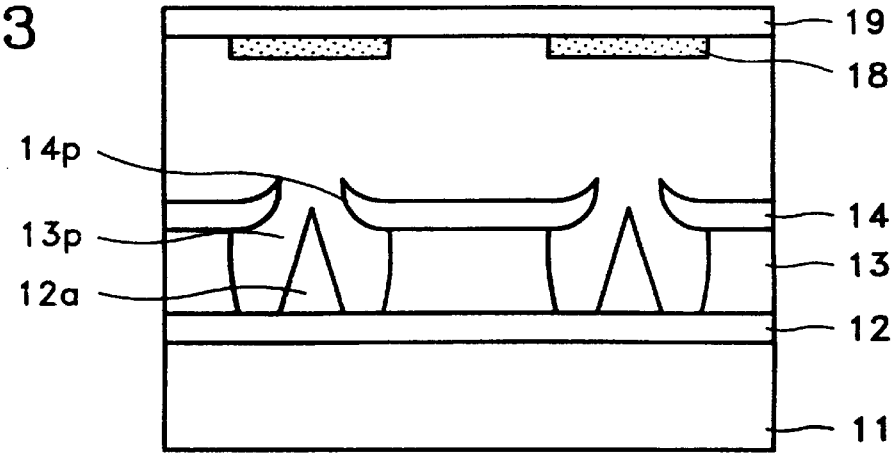
FIG. 13 is a schematic sectional view showing a preferred embodiment of applying the field emission device according to the present invention as an image display device.

Referring to FIG. 13, the electrons are emitted from the micro-tips 12*a* by applying fluorescent objects 18 to the inside of an anode 19 in a vacuum and grounding a cathode 12 line or applying a negative bias voltage to the inside of the anode 19 and a positive bias voltage to a gate 14 line. At this time, the emitted electrons emit light after hitting the fluorescent objects 18 applied on the anode 19.

As described above, the method for manufacturing the field emission device according to the present invention provides a gate which is formed to have an aperture whose size is minute and uniform to lower a voltage for driving the display, and which is formed by using an inclined plane of a silicon column-shaped tip structure by a conventional mask align (2 $\mu$m level) having a low resolution. Therefore, the present invention can be applied to a flat plate display device, extremely high frequency amplifier, sensor, etc.

What is claimed is:

1. A method for manufacturing a field emission device, comprising the steps of:

forming a cathode on a substrate;

forming a semiconductor material layer on said cathode;

forming a mask on said semiconductor material layer;

etching said semiconductor material layer to form a plurality of tips on said cathode, each of said plurality of tips having an upper portion and a lower portion;

depositing an insulating material on said cathode to form an insulating layer;

depositing a first metal on said insulating layer in a slanted angle direction to form a gate electrode having a protruded edge portion;

removing said mask and said plurality of tips to form a plurality of holes;

depositing a second metal on said gate electrode to form a plurality of micro-tips in said plurality of holes; and removing said second metal from said gate electrode.

2. A method for manufacturing a field emission device as claimed in claim 1, wherein said upper portion has a cone shape and said lower portion has a column shape in each of said plurality of tips.

3. A method for manufacturing a field emission device as claimed in claim 1, wherein said etching step comprises two different etching methods to form said upper and lower portions of said plurality of tips.

4. A method for manufacturing a field emission device, comprising the steps of:

forming a cathode on a substrate;

forming a semiconductor material layer on said cathode;

forming a mask on said semiconductor material layer;

etching said semiconductor material layer to form a plurality of tips, each of said plurality of tips having a cone-shaped upper portion and column-shaped lower portion;

forming an insulation layer by depositing an insulating material on said cathode and said mask in a vertical direction with respect to an upper surface of said mask;

forming a gate by depositing a first metal on said insulating layer in a predetermined direction in order to have an edge portion of said gate protruded toward an upper direction;

removing said mask, said insulating material and said first metal deposited sequentially on said mask;

forming a plurality of holes by etching said plurality of tips;

forming a plurality of micro-tips in said plurality of holes by forming a parting layer on said gate and depositing a second metal on said parting layer; and removing said parting layer and said second metal deposited thereon by an etching process.

5. A method for manufacturing a field emission device as claimed in claim 4, wherein said cone-shaped upper portion is formed by an isotropic reactive ion etching method and said column-shaped lower portion is formed by an anisotropic reactive ion etching method.

6. A method for manufacturing a field emission device as claimed in claim 5, wherein said isotropic reactive ion etching method employs $SF_6/O_2$ plasma and said anisotropic reactive ion etching method employs $CF_4/O_2$ plasma.

7. A method for manufacturing a field emission device as in claimed 6, wherein said semiconductor material layer is formed by depositing silicon.

8. A method for manufacturing a field emission device as claimed in claim 7, wherein said plurality of holes are formed by selectively etching said plurality of tips with a $SF_6/O_2$ plasma.

9. A method for manufacturing a field emission device as claimed in claim 4, wherein said gate is formed by depositing said first metal in a direction of between about 65° and 75° with respect to an upper surface of said mask.

10. A method for manufacturing a field emission device as claimed in claim 9, wherein said insulation layer is formed by depositing an insulating material up to a height of said column-shaped lower portion.

* * * * *